United States Patent [19]

Stahlecker et al.

[11] Patent Number: 4,646,389

[45] Date of Patent: Mar. 3, 1987

[54] FITTING FOR OPENING ROLLERS

[76] Inventors: Fritz Stahlecker, Josef-Neidhart Strasse 18, 7347 Bad Überkingen; Hans Stahlecker, Haldenstrasse 20, 7334 Süssen, both of Fed. Rep. of Germany

[21] Appl. No.: 820,798

[22] Filed: Jan. 22, 1986

[30] Foreign Application Priority Data

Jan. 22, 1985 [DE] Fed. Rep. of Germany ..... 3501876

[51] Int. Cl.[4] ..... D01H 7/895; D01G 15/14

[52] U.S. Cl. ..... 19/97; 19/112

[58] Field of Search ..... 19/97, 112, 113, 114

[56] References Cited

U.S. PATENT DOCUMENTS

| | | | |
|---|---|---|---|
| 2,731,676 | 1/1956 | Apthorp et al. | 19/114 |
| 2,937,413 | 5/1960 | Hollingsworth | 19/114 |
| 3,175,251 | 3/1965 | Reiterer | 19/114 |
| 3,204,297 | 9/1965 | Wada | 19/114 |
| 3,968,542 | 7/1976 | Hollingsworth | 19/112 X |
| 4,233,711 | 11/1980 | Hollingsworth | 19/114 |
| 4,392,276 | 7/1983 | Gauvain et al. | 19/112 X |
| 4,471,607 | 9/1984 | Schmolke | 19/97 X |

FOREIGN PATENT DOCUMENTS

| | | | |
|---|---|---|---|
| 2335057 | 1/1975 | Fed. Rep. of Germany | 19/113 |

*Primary Examiner*—Louis K. Rimrodt

*Attorney, Agent, or Firm*—Barnes & Thornburg

[57] ABSTRACT

An arrangement is provided for an opening roller having a plurality of teeth wherein the tooth faces exhibit an oblique curvature in the direction of rotation of the roller resulting in a face angle between 12° and 30° in the region of the tip of the tooth and a face angle of about +5° to −5° in the region of the bottom of the tooth leading to a curved portion which extends to the back of the preceeding tooth. The arrangement provides for improved combing action on the fiber band and results in improved wear characteristics among other beneficial results.

12 Claims, 2 Drawing Figures

Fig. 1
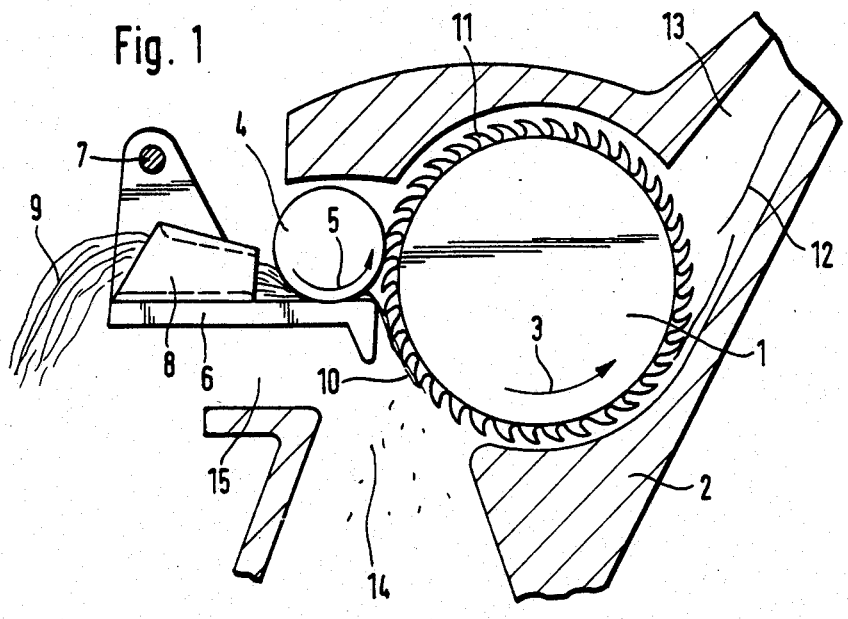
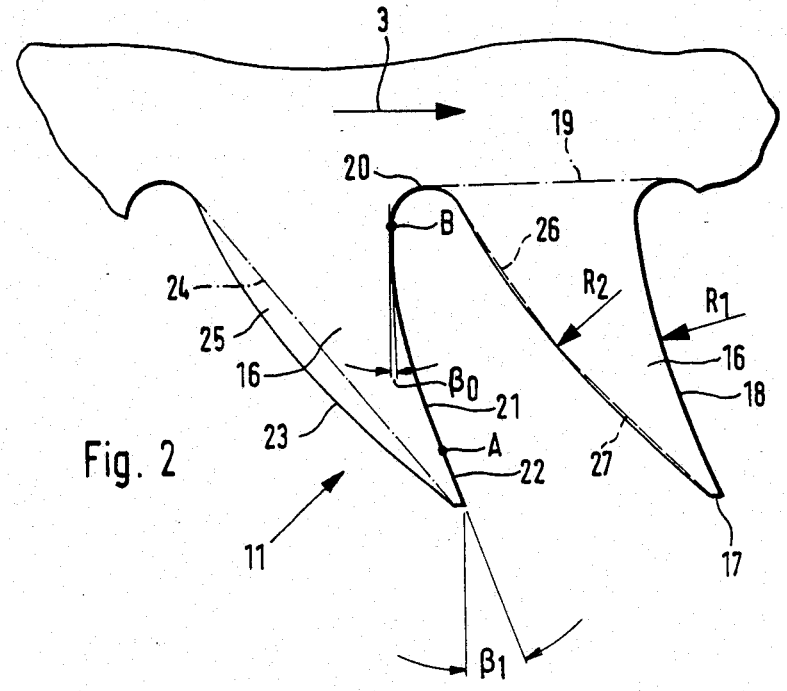
Fig. 2

FITTING FOR OPENING ROLLERS

BACKGROUND AND SUMMARY OF THE INVENTION

The present invention relates to an arrangement for an opening roller having a plurality of teeth sequentially arranged in several circumferentially extending rows. The faces of the teeth are sloped with a face angle of about 12° to 30° against the rotational direction, and connect in the region of the bottoms of the teeth with a curvature to the back of the respectively preceeding tooth.

The structural design of an opening roller has a substantial influence upon the quality of open-end spinning. The fiber material supplied in the form of a fiber band is opened by means of the opening roller arrangement to single fibers which are subsequently transported to the spinning surface. The particular arrangement of the opening roller serves, on the one hand, to open the fiber material as much as possible to single fibers whereby it is essential that damage to the fibers, especially shortening, is minimized. Additionally, the arrangement of the opening roller serves to separate any impurities present in the fiber material from the fibers and to spin off the same from the transport pass. Furthermore, the arrangement has to be designed in such a manner that the fibers are capable of loosening themselves in a predetermined way along the circumference of the opening roller, thereby enabling the preferred transport via a fiber channel to the spinning surface.

In practice, an arrangement consisting of needles has also been utilized instead of the primarily used arrangement of teeth. The teeth of a toothed roller are sequentially arranged in several rows extending in a spiral in the circumferential direction and the faces of the teeth connect with a curvature in the area of the tooth feet with a curvature to the tooth backs of the respectively preceeding tooth. The teeth of the known arrangement exhibit a straight extending tooth face and tooth back whereby the face, dependent upon the fiber material to be processed, exhibits a curve in the radial plane (the so-called face angle) of about 12° to 30°. Such teeth penetrate into the fiber material relatively gently at first contact. However, it has become apparent that these teeth, especially in the area of the bottoms of the teeth, are subject to substantial wear. The fibers to be combed out slide on the tooth surfaces in close proximity to the bottom of the teeth where most of the combing effort is executed. These arrangements are further subject to some extent to the problem that dirt particles having short fibers sticking to them may also slide into the area of the teeth bottoms and are not immediately spun off. The danger then exists that these dirt particles are removed later and reach the spinning surface downstream of the opening roller.

An object of the present invention is the provision of an arrangement of the above-mentioned kind for an opening roller in such a manner as to allow gentle penetration by teeth into the fiber material.

Another object of the present invention is the provision of an opening roller arrangement wherein the combing process is carried out over a greater range of the faces of the individual teeth.

A further object of the present invention is the provision of an opening roller wherein uneven wear of the individual teeth is avoided.

An even further object of the present invention is the provision of an opening roller arrangement wherein dirt particles attached to short fibers are spun off before they can be transported downstream to a spinning surface.

These and other objects are attained in the provision of an opening roller arrangement wherein the teeth surfaces are provided with a curvature in the direction of rotational movement of the roller while in operation in such a manner that the teeth surfaces exhibit a face angle between 12° and 30°, in the region of the teeth tips and connect in the area of the bottoms of the teeth with a face angle of about +5° to about −5° to the curvature leading to the bottom of the preceeding tooth.

This arrangement makes a face angle possible which results in a gentle penetration into the fiber material. At the same time, it is avoided that the fibers passing along the tooth face will all end up in the area of the bottom of the tooth. The actual combing process of the fibers is consequently executed over a greater range, of the teeth so that the combing effect is improved. Additionally, by providing a distribution of the combing process over a greater range a high amount in wear at a particular position is avoided. This will result in an increase in wear time of the arrangement. Another favorable result is that dirt particles attached to shorter fibers are caught only for a short period so that they can be spun off. Another advantage is that all fibers are removed more easily out of the arrangement so that the separation of the fibers at the separating station is improved.

In a further development of the invention, it is provided that the curvature of the tooth surfaces between the area of the tips and the feet of the teeth exhibit the same bending radius. This improvement is advantageous for reasons of manufacture. It is advantageously provided that the bending radius of the curvature of the tooth surfaces are in the range between 2.5 mm and 4.5 mm and preferably about 3.5 mm. These dimensions result in an especially effective opening characteristic with the commonly used dimensions of the arrangement with opening rollers.

In another development of the invention, it is provided that the tooth surfaces include in the outer region of the tooth tips a straight extending section of the length of about 1 mm which approximately connects tangentially to the curvature. It is thereby attained that the face angle remains constant over a predetermined length in the region of the tip of the tooth which is an advantage for the first penetration of the arrangement into the fiber material to be combed out.

In still another development of the invention, it is provided that the tooth bottoms are extended beyond a straight connection between the curvatures and the teeth tips against the rotational direction. This has the advantage that without essentially strengthening the teeth in the area of the teeth tips, the teeth shoulders are enlarged extending in the circumferential direction, thereby accelerating the fibers from the teeth of the opening roller and obtaining a higher speed. The drawing effect of the fibers is thereby also improved. This acceleration to a higher speed is attained without increasing the rotational velocity of the opening roller which would lead to an increased damaging effect on the fibers.

Other objects, advantages and novel features of the present invention will become apparent from the following detailed description of the invention when considered in conjunction with the accompanying drawings.

BRIEF DESCRIPTION OF THE DRAWINGS

FIG. 1 shows a cross-sectional view of an opening device containing an opening roller for an open-end spinning arrangement in accordance with the present invention, and FIG. 2 shows an enlarged side view of several teeth from the arrangement of the opening roller in accordance with FIG. 1.

DETAILED DESCRIPTION OF THE DRAWINGS

The opening device shown in FIG. 1 includes an opening roller 1 which is rotatably supported in an opening roller housing 2 and is driven in arrow direction 3 with drive means (not shown). The rotational speed of the opening roller 1 typically ranges between 5,000 to 8,000 rotations per minute. The opening roller 1 is arranged adjacent a feeding roller 4 rotating essentially slower than the opening roller 1 which is driven in arrow direction 5 at a feeding speed and by means of a drive device (not shown). The feeding roller 4 is arranged with a feeding table 6 which is pivotable about shaft 7 and is pressed against the feeding roller 4 by resilient means not shown here, together with which the same forms a clamping line. The feeding table 6 supports a feeding hopper 8 through which a fiber band 9 is supplied for the spinning process. The fiber band 9 is transported by the feeding roller 4 to the opening roller 1. The opening roller combs it out by means of arrangement 11 to a fiber beard 10 by separating the fibers 12 which are then transported via a fiber feeding channel 13 to the spinning surface such as an open-end spinning rotor (not shown).

The opening roller housing 2 surrounds the opening roller 1 with guiding surfaces. A dirt separator opening 14 is provided in the opening roller housing 2 in the area succeeding the feeding roller 4 and the feeding table 6 exhibiting a fiber beard support. Through opening 14, dirt particles of the fiber material are spun out of the fiber beard 10. An air stream is drawn in through an air inlet opening 15 following the feeding table 6 and for the dirt separator opening 14. This air stream effects the transport of the fibers 12 into the fiber feed channel 13.

The device 11 of the opening roller 1 should advantageously be designed in such a manner that it gently penetrates the fiber beard 9 at the position of its initial penetration (which takes place in the area of the deflection point) without tearing up the fibers which are stil clampingly held between the feeding roller and the feeding table 6. It is thereby noted that the difference in rotational speed between the device 11 and the fiber band 9 being supplied is very large. The device 11 exhibits a speed in the range of 40 meters per second while, on the other hand, the fiber band 9 exhibits a relatively small speed. After the initial penetration, the combing action whereby the fibers are carried and drawn by device 11 would be conducted in such a manner that the single fibers are not shortened. The impurities contained in the fiber band 9 should be drawn off by the separator opening 14 and are not carried beyond the same since they would otherwise reach the spinning surface via the fiber feeding channel 13. The fibers 12 subsequent to the separator opening 14 should be loosened by the device 11 of the opening roller and should reach the fiber channel 13 in a straight formation.

It was determined that the above-described requirements are advantageously met by a device 11 as it is shown in FIG. 2. The device 11 consists of a plurality of teeth 16 which are sequentially arranged in several spiral rows extending in waves or inclined in the circumferential rotational direction of the opening roller 1. Each of the teeth 16 include a tooth tip 17 the outermost end of which is removed by a twisting off process. A tooth face 18 extends from this tooth tip 17 designed as a front edge facing in the rotational direction which gradually changes into a curvature 20 in the area of the tooth bottoms 19 indicated by a dotted line. The curvature 20 then extends to the tooth back 23 of the respectively preceeding tooth 16. The teeth faces 18 include curvatures having a bending radius R1 which are sloped forward in the rotational direction 3. This radius is between about 2.5 mm to 4.5 mm. A preferred value for the bending radius R1 is about 3.5 mm. The curvature having a bending radius R1 extends over a distance between points A and B of the tooth face 18. Point A is about 1 mm or less away from the tip of the tooth 17.

The outermost tooth surfaces 18 extend from this point A in a straight manner along a distance 22 outwardly to the tip of the tooth 17. This straight section 22 connects tangentially to section 21 exhibiting a constant radius of curvature. Point B is positioned in the region of the tooth bottoms 19 and is the point where tooth section 21 of the tooth faces 18 exhibit the curvature which connects the teeth faces 18 respectively with the tooth backs, in 23 of the preceeding tooth 16. The location of the center point for calculating the bending radius R1 is chosen in such a manner that the tooth faces 18 form a face angle $B_1$ with a radial plain extending through the axis of rotation of the opening roller and through the tip of the tooth 17. The angle $B_1$ is less than 30° and is preferably in the range between 12° and 25°. Section 21 of the tooth faces 18 exhibits in the area of the curvature a face angle $B_0$ extending outwardly from point B, which angle is in the range between +5° and −5°. Preferably the face angle $B_0$ is 0°, which means the starting point of section 21 facing the tooth bottoms extend radially to the tooth faces 18.

The curvature 20 between the tooth faces 18 and the tooth backs 23 exhibit a radius of about 0.15 mm to 0.5 mm and preferably a radius of 0.35 mm. The tooth back 23 connecting curvature 20 with the tips of the teeth 17 extends opposite the rotational direction 3 beyond the straight connection which is indicated by line 24 in FIG. 2. The backs of the teeth 23, in a first embodiment, include a convex slope directed against the rotational direction 3 so that the surfaces of the side shoulders of teeth 16 which extend essentially in circumferential direction, are enlarged by the area 25 positioned between the dotted line 24 and the tooth backs 23. The bending radius R2 for the convex curvature of tooth backs 23 is in the range between 5 mm and 9 mm, and preferably about 7 mm. With a different embodiment which is shown in FIG. 2 at the right tooth with dotted lines, the tooth back 23 is formed by two or more straight sections 26 which approach a convex curvature in a polygon-like manner.

Due to the face angle $B_1$ being in the range between preferably 12° and 25° in the area of the tooth tip 17, the teeth 16 penetrate the fiber band 9 very gently. The face angle $B_1$ selected is dependent upon the fiber material to be processed. The angle is larger with cotton than with synthetic staple fiber material. After the teeth 16 have penetrated the fiber band 9 presented as a fiber beard 10, the combing out process occurs essentially in the concavely sloped section 21 of the tooth faces. By providing the curvature of this section 21, the fibers are not all pushed back into the area of the teeth bottoms 19 so that the combing out actually occurs over a relatively large, radial length of the teeth faces 18 of teeth 16. This curvature has a further advantage in that dirt particles or the like having short fibers attached thereto are not forced into the area of the tooth faces 18 but are instead removed relatively early on by the device 11 due to attached centrifugal forces associated with rotation of the opening roller. These particles are then disposed of in the area of the separator opening 14 with a greater certainty.

Subsequent to the combing out, the fibers are transported in the circumferential direction of the opening roller 1 by an air stream produced essentially by the rotation of the opening roller and the device 11, and secondarily by friction forces exercised by the fibers 12 upon teeth 16. By the enlarged extension of the tooth backs 23 against the rotational direction which is due to the enlargement of the tooth shoulders, this sort of carrying effect upon the single fibers is improved so that the same accelerate more without it becoming necessary to increase the rotational speed of the opening roller 1, and finally reach a very high end speed. This then improves the drawing effect exercised upon the fibers 12 while, at the same time, the opening of fibers 12 by means of the device 11 of opening roller 1 is improved in the area of the opening of the fiber feed channel 13.

The device 11 incorporating such teeth 16 as described, can be produced by several methods. In a first method, the teeth 16 are an integral part of a so-called saw-toothed wire which is wound in a spiral-like manner onto a roller or a shell connected with a roller, and attached thereto. In another method, the teeth 16 are an integral part of single rings extending in the circumferential direction of the opening roller 1 or a shell in a wave-like manner. In a third method, teeth 16 are directly worked into the cylindrical surface of a roller or into a ring. In this case a heat treatable or hardening material is provided for the ring or the roller. The teeth 16 are then produced by grinding of the circumference whereby ring grooves extending essentially in circumferential direction are cut therein which preferably exhibit a sloping in the radial planes or upon spiral grooves which form the side flanks of teeth 16. The teeth faces 18 and the tooth backs 23 are produced then essentially in the axial direction along mantle lines, or grooves being cut in and extending with a slight slope.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

What is claimed is:

1. Tooth arrangement for an opening roller including a plurality of radially extending teeth arranged on a rotatable cylindrical surface in substantially circumferentially extending rows, said cylindrical surface capable of being rotated in a directional rotation, said teeth having faces inclined toward the direction of rotation of said cylindrical surface, adjacent teeth being connected to one another within said rows at curved regions extending from a bottom portion of a face of one tooth to a bottom portion of a back of an adjacent tooth, wherein said tooth face in the vicinity of the curved region is radially curved toward said direction of rotation, wherein each of said faces exhibits a concave curvature, each said tooth having a tip portion exhibiting a face angle of between about 12° and 30° and a bottom portion exhibiting a face angle of between about +5° to −5° to the curvature leading to said back portion of an adjacent tooth, wherein said concave curvature of said tooth faces exhibits a constant bending radius between said tip portion and said bottom portion, and wherein said tooth faces comprise a straight section at said tip region, said straight section being substantially tangent to said concave curvature.

2. An arrangement according to claim 1, wherein said bending radius is between about 2.5 millimeters and 4.5 millimeters.

3. An arrangement according to claim 2, wherein said bending radius is about 3.5 millimeters.

4. An arrangement according to claim 1, wherein said straight section is about 1 millimeter in length.

5. An arrangement according to claim 1, wherein said curved region exhibits a radius of curvature between about 0.15 millimeters and 0.5 millimeters.

6. An arrangement according to claim 5, wherein said radius of curvature is about 0.35 millimeters.

7. An arrangement according to claim 1, wherein said back portions of said teeth comprised a flat surface extending between said curved region and said tip portions.

8. An arrangement according to claim 1, wherein said back portions of said teeth comprised a convex curved surface extending between said curved region and said tip portions.

9. An arrangement according to claim 8, wherein said convex curved surface exhibits a bending radius of between about 5 millimeters and 9 millimeters.

10. An arrangement according to claim 9, wherein said bending radius is about 7 millimeters.

11. An arrangement according to claim 1, wherein said back portions of said teeth comprised at least two non-parallel flat surfaces connected so as to form a substantially convex back configuration.

12. An arrangement according to claim 11, wherein said back portion comprises two non-parallel flat surfaces.

* * * * *